US008628314B2

(12) United States Patent
Takeuchi et al.

(10) Patent No.: US 8,628,314 B2
(45) Date of Patent: Jan. 14, 2014

(54) SCROLL COMPRESSOR INCLUDING A COMMUNICATION SECTION BETWEEN THE SUCTION CHAMBER AND THE SUPPLY FLOW PATH

(75) Inventors: Makoto Takeuchi, Aichi (JP); Hiroshi Yamazaki, Aichi (JP); Shinta Mishima, Aichi (JP); Tomohisa Moro, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 231 days.

(21) Appl. No.: 13/123,565

(22) PCT Filed: Dec. 1, 2009

(86) PCT No.: PCT/JP2009/070155

§ 371 (c)(1),
(2), (4) Date: Apr. 11, 2011

(87) PCT Pub. No.: WO2010/064619

PCT Pub. Date: Jun. 10, 2010

(65) Prior Publication Data

US 2011/0194966 A1 Aug. 11, 2011

(30) Foreign Application Priority Data

Dec. 2, 2008 (JP) ..... 2008-307372

(51) Int. Cl.
*F03C 2/00* (2006.01)
*F03C 4/00* (2006.01)
*F04C 2/00* (2006.01)

(52) U.S. Cl.
USPC ..... 418/55.2; 418/55.5; 418/55.6; 418/57

(58) Field of Classification Search
USPC ..... 418/55.1–55.6, 57, 181
See application file for complete search history.

(56) References Cited

U.S. PATENT DOCUMENTS 4,470,778 A * 9/1984 Mabe ..... 418/55.6
4,547,138 A * 10/1985 Mabe et al. ..... 418/55.6

(Continued)

FOREIGN PATENT DOCUMENTS

JP 8-200244 A 8/1996
JP 8-219053 A 8/1996
JP 2005-351112 A 12/2005
JP 2007-285187 A 11/2007
JP 2007332919 A * 12/2007 ..... F04C 18/02

OTHER PUBLICATIONS

International Search Report of PCT/JP2009/070155, date of mailing Feb. 23, 2010.

(Continued)

*Primary Examiner* — Theresa Trieu
(74) *Attorney, Agent, or Firm* — Westerman, Hattori, Daniels & Adrian, LLP

(57) ABSTRACT

A scroll compressor includes a housing; a fixed scroll fixed in the housing; an orbiting scroll that has an orbiting end plate on which a spiral orbiting wall is provided upright and that is supported in the housing so as to be able to orbit while being prevented from rotating, in a state where the orbiting wall is engaged with the fixed wall; a suction section that makes refrigerant containing lubricant flow into a suction chamber provided in the housing; and a plurality of supply flow paths that are provided on a sliding surface between the housing and the orbiting end plate and that are connected to the suction chamber.

5 Claims, 5 Drawing Sheets

(56) References Cited

U.S. PATENT DOCUMENTS

| | | | | |
|---|---|---|---|---|
| 5,759,021 | A | 6/1998 | Yamaguchi et al. | |
| 6,227,831 | B1 * | 5/2001 | Osima et al. | 418/55.4 |
| 7,255,543 | B2 * | 8/2007 | Yokoyama | 418/55.6 |
| 2003/0152467 | A1 * | 8/2003 | Higashiyama et al. | 418/60 |
| 2005/0271534 | A1 | 12/2005 | Yokoyama | |

OTHER PUBLICATIONS

Japanese Notice of Allowance dated Apr. 16, 2013, issued in corresponding Japanese Patent Application No. 2008-307372. Explanation of relevance—"The Decision to Grant a Patent has been received".

* cited by examiner

SCROLL COMPRESSOR INCLUDING A COMMUNICATION SECTION BETWEEN THE SUCTION CHAMBER AND THE SUPPLY FLOW PATH

TECHNICAL FIELD

The present invention relates to a scroll compressor.

BACKGROUND ART

In general, in scroll compressors, some sliding parts, such as a rotation-preventing mechanism and a drive bearing that supports a rotary shaft for driving an orbiting scroll, tend to be disposed at positions away from a flow path through which a fluid mixture of refrigerant and lubricant flows.

Therefore, various technologies have been proposed for supplying lubricant together with refrigerant to the above-described drive bearing etc., by forming, in a scroll compressor, an inner-circulation flow path for guiding sucked refrigerant to the drive bearing etc. (for example, see PTLs 1 and 2).

In the above-described technology disclosed in PTL 2, lubrication of the drive bearing etc. is performed by forming grooves (gas communication grooves) extending in the radial directions and disposed at regular intervals on a contact surface between an end plate of an orbiting scroll and a housing for accommodating the orbiting scroll etc.

Specifically, a fluid mixture of refrigerant and lubricant is supplied to the drive bearing etc. through the above-described gas communication grooves.

CITATION LIST

Patent Literature

{PTL 1} Japanese Unexamined Patent Application, Publication No. Hei-8-200244

{PTL 2} Japanese Unexamined Patent Application, Publication No. 2007-285187

SUMMARY OF INVENTION

Technical Problem

However, in the above-described technology disclosed in PTL 2, when the orbiting scroll orbits (revolves) one time, the gas communication grooves are completely closed one time by the end plate of the orbiting scroll. In other words, the flow of lubricant etc. flowing toward the drive bearing etc. through the gas communication grooves is temporarily blocked.

As a result, there is a problem in that the flow rate of lubricant etc. supplied to the drive bearing etc. is reduced, which may cause trouble, such as poor lubrication.

The present invention has been made in order to solve the above-described problem, and an object thereof is to provide a scroll compressor capable of improving the supply of lubricant to the sliding parts.

Solution to Problem

In order to achieve the above-described object, the present invention provides the following solutions.

The present invention provides a scroll compressor including: a housing; a fixed scroll that has a fixed end plate on which a spiral fixed wall is provided upright and that is fixed in the housing; an orbiting scroll that has an orbiting end plate on which a spiral orbiting wall is provided upright and that is supported in the housing so as to be able to orbit while being prevented from rotating, in a state where the orbiting wall is engaged with the fixed wall; a drive shaft that is rotatably supported by a bearing section provided in the housing and that transfers a rotational force to the orbiting scroll; a suction section that makes refrigerant containing lubricant flow into a suction chamber provided in the housing; and a plurality of supply flow paths that are provided on a sliding surface between the housing and the orbiting end plate and that are connected to the suction chamber, in which, in the vicinity of an outer end, in a radial direction, of a supply flow path extending toward the suction section, among the plurality of supply flow paths, a communication section that always ensures a connection between the suction chamber and the supply flow path is provided on at least one of the housing and the orbiting end plate.

According to the present invention, since the communication section is provided, lubricant can always be supplied to parts requiring lubrication, such as the bearing section. Furthermore, by providing the communication section in the vicinity of the suction section, it is possible to more reliably supply lubricant to the bearing section etc., compared with a case where the communication section is provided in another portion.

Specifically, with the communication section being provided, temporary blocking between the supply flow path and the suction chamber is prevented when the orbiting scroll orbits. Therefore, it is possible to always ensure the supply of lubricant to the bearing section etc. from the suction chamber via the supply flow path.

Furthermore, since the communication section is provided in the vicinity of the suction section, the momentum of refrigerant flowing into the suction chamber can be utilized to flow lubricant together with the refrigerant from the suction chamber into the supply flow path and to supply the lubricant to the bearing section etc.

In the above-described invention, it is preferable that the communication section provided on at least one of the housing and the orbiting end plate have a concave shape that is concave in the radial direction.

According to this structure, for example, compared with a case where the communication section extends in a circumferential direction of the drive shaft, it is possible to make refrigerant and lubricant flow from the suction chamber into the supply flow path without diverting them. Furthermore, since the communication section is formed as a narrow area, the communication section is easily formed.

In the above-described invention, it is preferable that the depth of the concave shape of the communication section provided on the orbiting end plate be smaller than the thickness of the fixed wall.

According to this structure, by setting a given limitation to the concave shape of the communication section, it is possible to prevent any influence on the formation of the compression chambers for compressing refrigerant and to suppress deterioration in compression performance of the scroll compressor.

Specifically, the face of the orbiting end plate facing the fixed scroll is brought into contact with the fixed wall, slides thereon, and forms the compression chambers for compressing refrigerant, together with the fixed scroll. Therefore, by limiting the depth of the concave shape of the communication section to be smaller than the thickness of the fixed wall, it is possible to separate the compression chambers and the communication section even when the compression chambers C move closest to the communication section.

In the above-described invention, it is preferable that the housing include a front housing having a substantially cylindrical shape having a bottom, which is almost closed at an orbiting scroll side and is open at a fixed-scroll side, and a rear housing that covers an opening of the front housing; and an end face of the communication section provided on the orbiting end plate be tilted inward in the radial direction from an orbiting end plate side toward a fixed-end-plate side, the end face facing the housing.

According to this structure, sufficient flow-path cross-sectional area of the communication section is ensured, thereby making it possible to ensure a lubricant flow between the communication section and the housing and to ensure a sufficient amount of lubricant supplied to the bearing section etc.

Specifically, as described above, in a case where the housing including the front housing and the rear housing is formed through casting, the inner face of the housing is provided with a draft angle tilting radially outward toward the opening. In this state, when the end face of the communication section is tilted at an angle close to the draft angle, the flow path between the communication section and the housing is prevented from being narrowed.

As a result, it is possible to ensure a lubricant flow between the communication section and the housing and to ensure a sufficient amount of lubricant supplied to the bearing section etc.

In the above-described invention, it is preferable that the communication section provided on at least one of the housing and the orbiting end plate be a groove that is made concave in a direction in which the drive shaft extends and that extends in a circumferential direction of the drive shaft.

According to this structure, for example, compared with the communication section that is concave in the radial direction, a surface of the orbiting end plate that is brought into contact with the fixed wall is easily ensured, and sufficient thickness of the side wall of the housing is easily ensured.

Advantageous Effects of Invention

According to the scroll compressor of the present invention, an advantage is afforded in that, since the communication section is provided in the vicinity of the suction section, it is possible to always supply lubricant to parts requiring lubrication, such as the bearing section, and to improve the supply of lubricant to the sliding parts.

DESCRIPTION OF EMBODIMENTS

First Embodiment

A scroll compressor according to a first embodiment of the present invention will be described below with reference to FIGS. 1 to 5.

Figure 1:
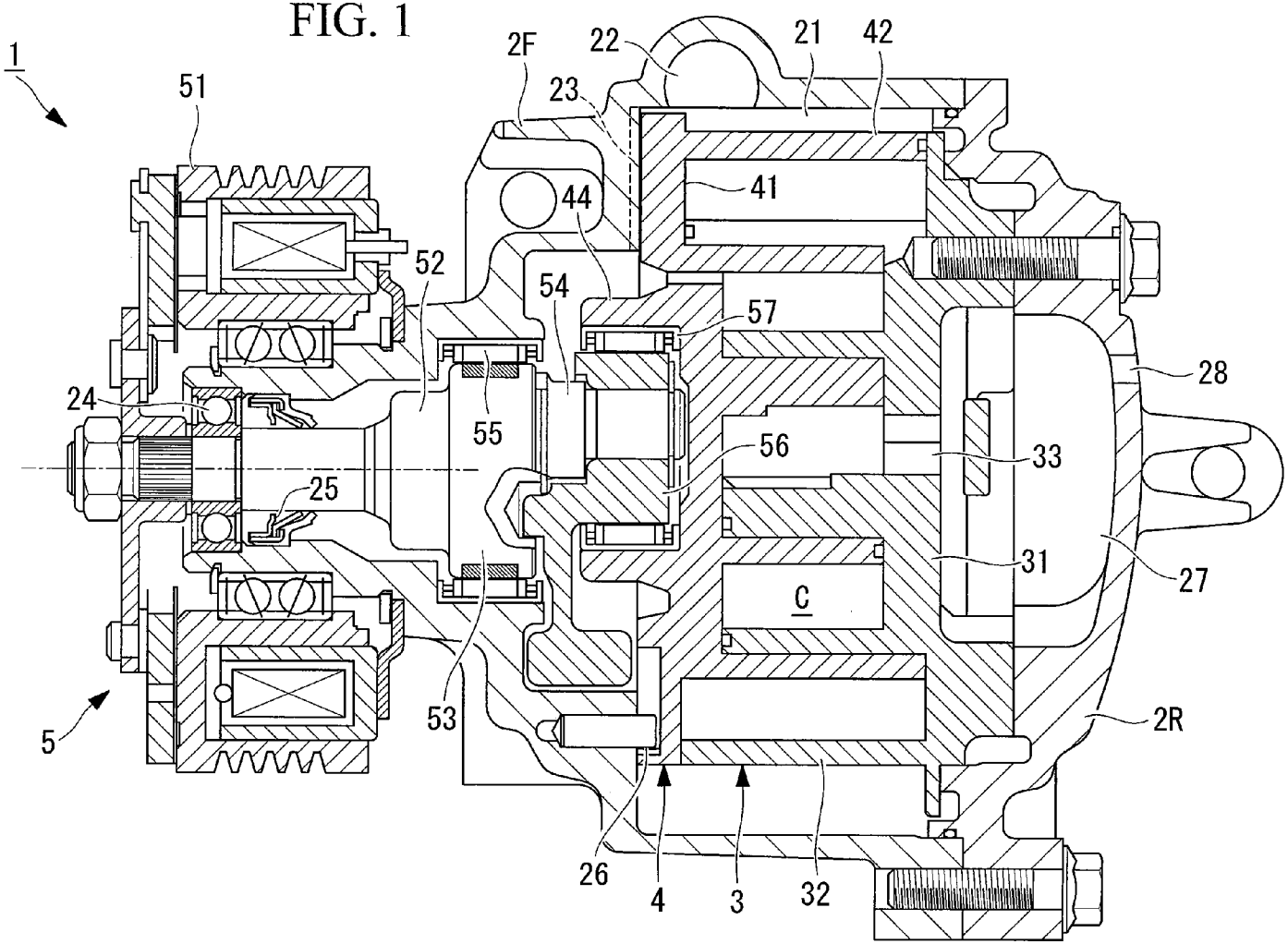
FIG. 1 is a schematic view for explaining the structure of a scroll compressor according to a first embodiment of the present invention.

FIG. 1 is a schematic view for explaining the structure of the scroll compressor of this embodiment.

In this embodiment, a description will be given of a case where a scroll compressor according to the present invention is used as a transverse scroll compressor used for vehicle air-conditioning apparatuses; however, it can be used for other air-conditioning apparatuses, and the purpose thereof is not particularly limited.

As shown in FIG. 1, a scroll compressor 1 includes a front housing (housing) 2F and a rear housing (housing) 2R that form an outer shape of the scroll compressor 1, a fixed scroll 3 and an orbiting scroll 4 that compress refrigerant, and a driving section 5 that drives the orbiting scroll 4.

Together with the rear housing 2R, the front housing 2F constitutes a closed container for accommodating the fixed scroll 3 and the orbiting scroll 4 and also forms the outer shape of the scroll compressor 1.

The front housing 2F is a member formed in a substantially cylindrical shape having a bottom, which is closed at the orbiting scroll 4 side, the orbiting scroll 4 to be described later, and is open at the fixed scroll 3 side. In other words, the front housing 2F is a member formed in a substantially cylindrical shape having a bottom, which is open at the end closer to the rear housing 2R and is closed at the other end.

As shown in FIG. 1, the front housing 2F is provided with a suction section 22 that makes refrigerant flow from the outside into a suction chamber 21, and a plurality of supply flow paths 23 that communicate with the suction chamber 21.

The suction section 22 is connected, for example, to an interior heat exchanger (not shown) of an air-conditioner that includes the scroll compressor 1 as a component, and refrigerant flows from the indoor heat exchanger into the suction section 22.

Furthermore, the suction section 22 is an opening provided on a cylindrical side wall of the front housing 2F and communicates with the suction chamber 21.

The suction chamber 21 is a cylindrical space formed between the front housing 2F, and the orbiting scroll 4 and the fixed scroll 3, and communicates with the outside via the suction section 22.

The suction chamber 21 also communicates with the supply flow paths 23 and communication sections 43.

Figure 2:
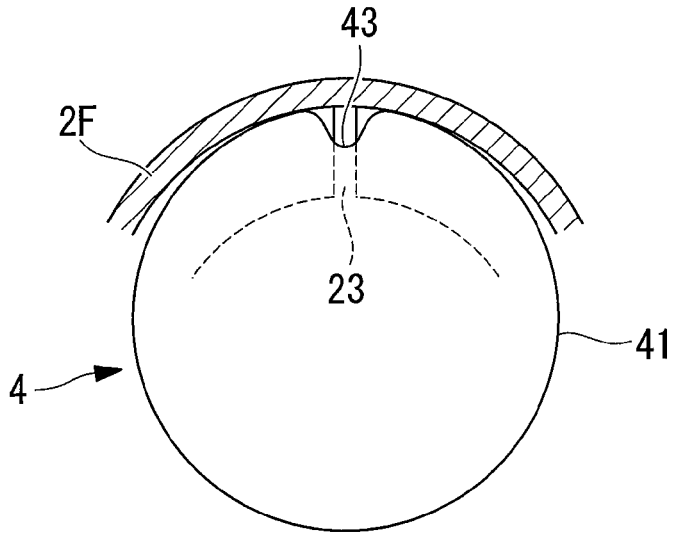
FIG. 2 is a schematic view for explaining the structure of a communication section shown in FIG. 1.

FIG. 2 is a schematic view for explaining the structures of each supply flow path shown in FIG. 1 and each communication section.

The supply flow paths 23 communicate with a first bearing 24, to be described later, a lip seal section 25, the vicinities of a second bearing 55 and an eccentric bush 56, and the suction chamber 21.

As shown in FIGS. 1 and 2, the supply flow paths 23 are defined by an orbiting end plate 41, to be described later, and grooves formed in the front housing 2F. Furthermore, the supply flow paths 23 extend in radial directions of the drive shaft 52 and are arranged at regular intervals.

As shown in FIG. 1, the first bearing (bearing section) 24 and the lip seal section 25 are provided between the front housing 2F and the drive shaft 52.

The first bearing 24 supports the drive shaft 52 such that the drive shaft 52 can rotate about the central axis. Examples of the first bearing 24 include a ball bearing, and the type thereof is not particularly limited.

The lip seal section 25 separates the inside and the outside of the front housing 2F and the rear housing 2R; in other words, it ensures the sealing of the inside of the front housing 2F and the rear housing 2R.

Furthermore, the lip seal section 25 ensures the above-described sealing while allowing the drive shaft 52 to rotate about the central axis; in other words, it ensures the sealing while sliding over the rotating drive shaft 52.

Note that a known seal member can be used as the lip seal section 25, and the type thereof is not particularly limited.

As shown in FIG. 1, a rotation-preventing mechanism 26 is provided between the front housing 2F and the orbiting scroll 4. The rotation-preventing mechanism 26 prevents rotational motion of the orbiting scroll 4 while permitting orbital motion thereof.

Note that a known mechanism can be used as the rotation-preventing mechanism 26, and the type thereof is not particularly limited.

Together with the front housing 2F, the rear housing 2R constitutes the closed container for accommodating the fixed scroll 3 and the orbiting scroll 4 and also forms the outer shape of the scroll compressor 1.

The rear housing 2R is formed in a lid-like shape for covering the opening of the front housing 2F, and the fixed scroll 3 is fixed in the rear housing 2R.

As shown in FIG. 1, the rear housing 2R is provided with a discharge section 28 that guides refrigerant from a discharge chamber 27 to the outside.

The discharge section 28 is connected, for example, to an outdoor heat exchanger (not shown) of the air-conditioner that includes the scroll compressor 1 as a component, and refrigerant flows from the discharge section 28 into the outdoor heat exchanger.

Furthermore, the discharge section 28 is an opening provided in the rear housing 2R and communicates with the discharge chamber 27.

The discharge chamber 27 is a space formed between the rear housing 2R and the fixed scroll 3 and communicates with the outside via the discharge section 28.

The discharge chamber 27 also communicates with a discharge port 33, to be described later.

The fixed scroll 3 forms compression chambers C for compressing refrigerant, together with the orbiting scroll 4. The fixed scroll 3 is fixed to the rear housing 2R by using fixing members, such as bolts.

As shown in FIG. 1, the fixed scroll 3 is provided with a fixed end plate 31 fixed to the rear housing 2R and a fixed wall 32 engaged with an orbiting wall 42, to be described later.

The fixed end plate 31 constitutes the fixed scroll 3 together with the fixed wall 32 and is an approximately disc-like member fixed to the rear housing 2R.

As shown in FIG. 1, the fixed end plate 31 has the discharge port 33 that connects the compression chambers C to the discharge chamber 27.

The discharge port 33 is a through-hole formed at substantially the center of the fixed end plate 31, in other words, in the vicinity of an inner end of the fixed wall 32.

A plate-like valve that controls opening and closing of the discharge port 33 is provided at an opening of the discharge port 33 closer to the discharge chamber 27. By controlling the opening and closing of the discharge port 33 is controlled with the valve, refrigerant always flows from the compression chambers C into the discharge chamber 27.

Furthermore, the fixed end plate 31 has a high face portion whose face is higher in an outward spiral direction, a low face portion whose face is lower in an inward spiral direction, and a semi-cylindrical end-plate step portion formed between the high face portion and the low face portion.

The fixed wall 32 constitutes the fixed scroll 3 together with the fixed end plate 31. The fixed wall 32 extends from the fixed end plate 31 toward the orbiting scroll 4 and is formed in a spiral shape defined based on an involute curve.

The tooth top of the fixed wall 32 has a low portion where the tooth height is lower in the outward spiral direction, a high portion where the tooth height is higher in the inward spiral direction, and a wall step portion formed between the low portion and the high portion.

The orbiting scroll 4 forms the compression chambers C for compressing refrigerant, together with the fixed scroll 3. The orbiting scroll 4 and the fixed scroll 3 are eccentric to each other by a predetermined distance and are engaged with a shift of 180 degrees, thereby forming the plurality of compression chambers C.

As shown in FIG. 1, the orbiting scroll 4 is provided with the orbiting end plate 41 and the orbiting wall 42.

The orbiting end plate 41 constitutes the orbiting scroll 4 together with the orbiting wall 42.

As shown in FIGS. 1 and 2, the orbiting end plate 41 is provided with the communication sections 43 and a boss section 44.

As shown in FIG. 2, the communication sections 43 ensure connections between the suction chamber 21 and the supply flow paths 23, in the vicinities of radially-outer ends of the supply flow paths 23 extending toward the suction section 22.

The communication sections 43 are formed when the end face of the orbiting end plate 41 facing the suction section 22 is formed in smooth sinusoidal shapes that are concave inward in the radial directions.

With this structure, for example, compared with a case where the communication sections 43 extend in a circumferential direction of the drive shaft 52, it is possible to make refrigerant and lubricant flow from the suction chamber 21 into the supply flow paths 23 without diverting them. Furthermore, since the communication sections 43 are formed as narrow areas, the communication sections 43 are easily formed.

Figure 3:
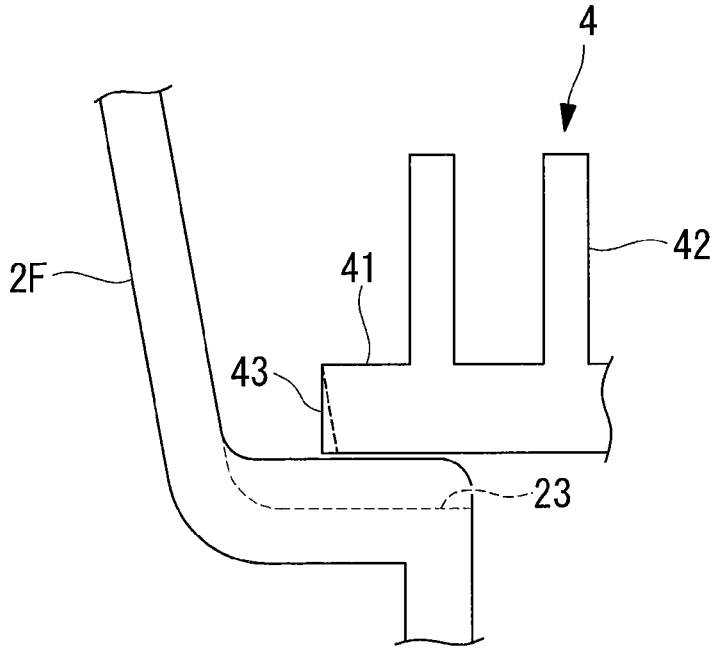
FIG. 3 is a schematic view for explaining the shape of the communication section shown in FIG. 2.

FIG. 3 is a schematic view for explaining the shape of the communication section shown in FIG. 2.

As shown by a solid line in FIG. 3, an end face of each of the communication sections 43 facing the front housing 2F is formed as a face extending parallel to the drive shaft 52, in other words, as a face substantially perpendicular to a face of the orbiting end plate 41 on which the orbiting wall 42 is provided.

Note that the end face of each communication section 43 may be formed as a face extending parallel to the drive shaft 52, as described above, or may be formed as a face tilting radially inward from the orbiting end plate 41 side toward the fixed end plate 31, in other words, as a tilted face extending substantially parallel to the inner circumferential face of the front housing 2F, as shown by a dashed line in FIG. 3; the shape of the end face of each communication section 43 is not particularly limited.

By doing so, sufficient flow-path cross-sectional area of the communication section 43 is ensured, thereby making it possible to ensure a lubricant flow between the communication section 43 and the front housing 2F and to ensure a sufficient amount of lubricant supplied to the first bearing 24, the second bearing 55, the lip seal section 25, etc.

Specifically, as described above, in a case where the front housing 2F is formed through casting, the inner face of the front housing 2F is provided with a draft angle tilting radially outward toward the opening. In this state, when the end face of the communication section 43 is tilted at an angle close to the draft angle, the flow path between the communication section 43 and the front housing 2F is prevented from being narrowed.

As a result, it is possible to ensure a lubricant flow between the communication section 43 and the front housing 2F and to ensure a sufficient amount of lubricant supplied to the first bearing 24, the second bearing 55, the lip seal section 25, etc.

Figure 4:
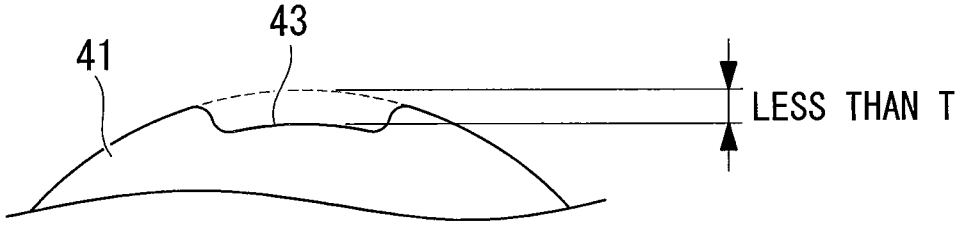
FIG. 4 is a schematic view for explaining another embodiment of the communication section shown in FIG. 2.

FIG. 4 is a schematic view for explaining another embodiment of the communication section shown in FIG. 2.

Note that the communication section 43 may be formed in a sinusoidal-concave shape, as in the above-described embodiment, or may be formed in a concave shape having a depth smaller than a thickness T of the orbiting wall 42, as shown in FIG. 4; the shape of the communication section 43 is not particularly limited.

By setting a given limitation to the concave shape of the communication section 43, it is possible to prevent any influence on the formation of the compression chambers C, for compressing refrigerant, and to suppress deterioration in compression performance of the scroll compressor 1.

Specifically, the face of the orbiting end plate 41 facing the fixed scroll 3 is brought into contact with the fixed wall 32, slides thereon, and forms the compression chambers C for compressing refrigerant, together with the fixed scroll 3. Therefore, by limiting the depth of the concave shape of the communication sections 43 to be smaller than the thickness of the fixed wall 32, it is possible to separate the compression chambers C and the communication sections 43 even when the compression chambers C move closest to the communication sections 43.

As shown in FIG. 1, the boss section 44 drives the orbiting scroll 4 in an orbital manner, together with a driving pin 54 and the eccentric bush 56, and is a cylindrical-shaped part provided on a face of the orbiting end plate 41 opposite to the face thereof on which the orbiting wall 42 is provided.

Furthermore, the orbiting end plate 41 has a high face portion whose face is higher in an outward spiral direction, a low face portion whose face is lower in an inward spiral direction, and a semi-cylindrical end-plate step portion formed between the high face portion and the low face portion.

The orbiting wall 42 constitutes the orbiting scroll 4 together with the orbiting end plate 41. The orbiting wall 42 extends from the orbiting end plate 41 toward the fixed scroll 3 and is formed in a spiral shape defined based on an involute curve.

The orbiting wall 42 has a low portion where the tooth height is lower in the outward spiral direction, a high portion where the tooth height is higher in the inward spiral direction, and a wall step portion formed between the low portion and the high portion.

The driving section 5 transfers a rotational driving force transferred from a vehicle engine (not shown) etc. to the orbiting scroll 4.

As shown in FIG. 1, the driving section 5 includes a pulley section 51 and the drive shaft 52.

The pulley section 51 is connected to the engine etc. via a drive belt, and a rotational driving force is transferred therefrom. The pulley section 51 further transfers the rotational driving force transferred from the engine etc. to the drive shaft 52.

Note that a known pulley can be used as the pulley section 51, and the type thereof is not particularly limited.

The drive shaft 52 transfers the rotational driving force transferred from the pulley section 51 to the orbiting scroll 4 and drives the orbiting scroll 4 in an orbital manner. The drive shaft 52 is supported rotatably about its axis by the first bearing 24 and the second bearing 55 provided on the front housing 2F.

As shown in FIG. 1, the drive shaft 52 is provided with a large-diameter section 53 and the driving pin 54.

The large-diameter section 53 is a discoid-shaped or cylindrical-shaped part provided on an end portion of the drive shaft 52 closer to the orbiting scroll 4. The large-diameter section 53 is formed to have a larger diameter than the drive shaft 52 and has the driving pin 54 disposed on a face thereof facing the orbiting scroll 4.

As shown in FIG. 1, the second bearing 55 is provided between the large-diameter section 53 and the front housing 2F.

The second bearing 55 supports the drive shaft 52 such that the drive shaft 52 can rotate about the central axis. Examples of the second bearing 55 include a needle bearing, and the type thereof is not particularly limited.

The driving pin 54 is a cylindrical-shaped part provided on the face of the large-diameter section 53 facing the orbiting scroll 4 and drives the orbiting scroll 4 in an orbital manner, together with the eccentric bush 56 and the boss section 44.

The driving pin 54 is disposed at a position eccentric from the central axis of the drive shaft 52 by a predetermined distance. The predetermined distance is substantially the same as the eccentric distance between the fixed scroll 3 and the orbiting scroll 4.

As shown in FIG. 1, the eccentric bush 56 is provided between the driving pin 54 and the boss section 44.

The eccentric bush 56 is disposed between the driving pin 54 and the boss section 44. Furthermore, the eccentric bush 56 is provided with a balance weight so as to compensate for a centrifugal force caused by the orbiting of the orbiting scroll 4.

A third bearing section 57 is provided between the eccentric bush 56 and the boss section 44.

The third bearing section 57 supports the eccentric bush 56 such that the eccentric bush 56 can rotate in the boss section 44. Examples of the third bearing section 57 include a needle bearing, and the type thereof is not particularly limited.

Next, compression of refrigerant in the scroll compressor 1, having the above-described structure, will be described.

In the scroll compressor 1, as shown in FIG. 1, a rotational driving force from the engine etc. is transferred to the drive shaft 52 via the pulley section 51. The rotational driving force is transferred to the orbiting scroll 4 via the driving pin 54, the eccentric bush 56, and the boss section 44. The orbiting scroll 4 is driven so as to perform an orbital motion on a circular orbit whose radius corresponds to the orbit radius, while being prevented from rotating by the rotation-preventing mechanism 26.

When the orbiting scroll 4 is driven in an orbital manner, refrigerant enters the suction chamber 21 via the suction section 22 and is sucked into the compression chambers C formed between the orbiting scroll 4 and the fixed scroll 3. Then, through the orbital motion of the orbiting scroll 4, the compression chambers C reach the center portion while reducing the volumes to compress the refrigerant.

When the compression chambers C reach the center portion, the compressed refrigerant is discharged from the compression chambers C to the discharge chamber 27 via the discharge port 33. The refrigerant in the discharge chamber 27 is discharged to the outside of the scroll compressor 1 via the discharge section 28.

Next, circulation of lubricant contained in refrigerant, which is a feature of this embodiment, will be described.

Refrigerant containing lubricant, flowing from the suction section 22 into the suction chamber 21 flows from the suction chamber 21 into the supply flow paths 23. The refrigerant containing lubricant flowing through the supply flow paths 23 inward in the radial directions flows in the vicinities of the second bearing 55, the first bearing 24, and the lip seal section 25, thereby supplying lubricant to those parts.

As a result, the lubrication in the first bearing 24, the second bearing 55, and the lip seal section 25 is ensured.

In a state where the scroll compressor 1 is operated, specifically, in a state where the orbiting scroll 4 is driven in an orbital manner, most of the supply flow paths 23 are closed by the orbiting end plate 41 one time in one orbit of the orbiting scroll 4, as shown in FIG. 2.

At this time, the communication sections 43 move to positions above the supply flow paths 23 and connect between the supply flow paths 23 and the suction chamber 21. Thus, the refrigerant containing lubricant flows from the suction chamber 21 into the supply flow paths 23 via the communication sections 43.

According to the above-described structure, since the communication sections 43 are provided, lubricant can always be supplied to parts requiring lubrication, such as the first bearing 24, the second bearing 55, and the lip seal section 25. Furthermore, it is possible to more reliably supply lubricant to the first bearing 24, the second bearing 55, the lip seal section 25, etc., by providing the communication sections 43 in the vicinities of the suction section 22, compared with a case where the communication sections 43 are provided in other portions.

In other words, it is possible to improve the supply of lubricant to sliding parts, such as the first bearing 24, the second bearing 55, and the lip seal section 25.

Specifically, with the communication sections 43 being provided, temporary blocking between the supply flow paths 23 and the suction chamber 21 is prevented when the orbiting scroll 4 orbits. Therefore, it is possible to always ensure the supply of lubricant to the first bearing 24, the second bearing 55, the lip seal section 25, etc. from the suction chamber 21 via the supply flow paths 23.

Furthermore, since the communication sections 43 are provided in the vicinities of the suction section 22, the momentum of refrigerant flowing into the suction chamber can be utilized to flow lubricant together with the refrigerant from the suction chamber 21 into the supply flow paths 23 and to supply the lubricant to the first bearing 24, the second bearing 55, the lip seal section 25, etc.

Figure 5:
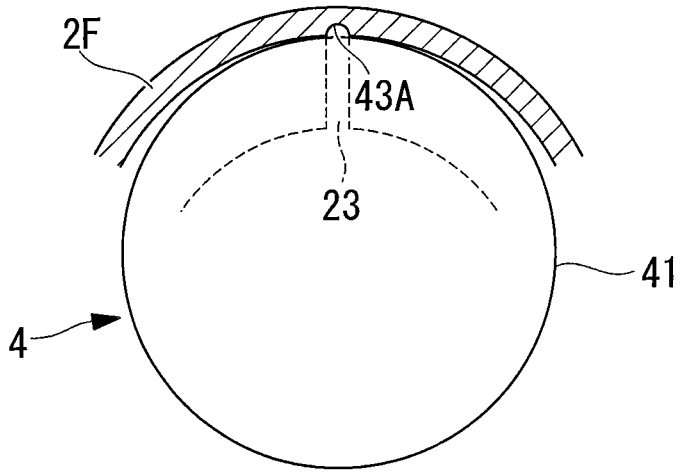
FIG. 5 is a schematic view for explaining still another embodiment of the communication section shown in FIG. 2.

FIG. 5 is a schematic view for explaining still another embodiment of the communication section shown in FIG. 2.

Note that the communication sections 43 may be formed in the orbiting end plate 41, as in the above-described embodiment, or groove-like communication sections 43A that continue from the supply flow paths 23 may be formed on the inner circumferential face of the front housing 2F, as shown in FIG. 5; the positions thereof are not particularly limited. In this case, the communication sections 43A are formed to extend further from the orbiting end plate 41 toward the fixed end plate 31.

Second Embodiment

Next, a second embodiment of the present invention will be described with reference to FIGS. 6 to 8.

The basic structure of a scroll compressor of this embodiment is the same as that of the first embodiment, but the position where a communication section is provided differs from that in the first embodiment. Therefore, in this embodiment, only a structure around the communication section will be described using FIGS. 6 to 8, and a description of the other components will be omitted.

Figure 6:
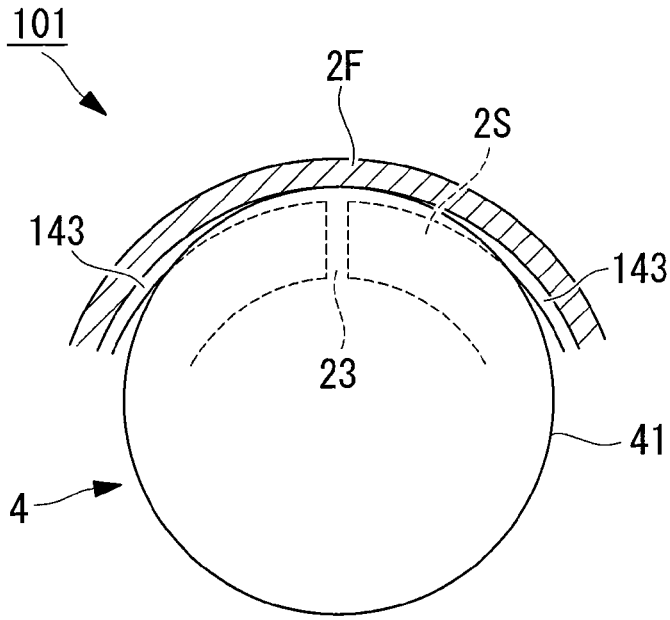
FIG. 6 is a schematic view for explaining the structure of a scroll compressor according to a second embodiment of the present invention.

FIG. 6 is a schematic view for explaining the structure of the communication section in the scroll compressor of this embodiment. FIG. 7 is a cross-sectional view for explaining the structure of the communication section shown in FIG. 6.

Note that identical reference symbols are assigned to the same components as those in the first embodiment, and a description thereof will be omitted.

Figure 7:
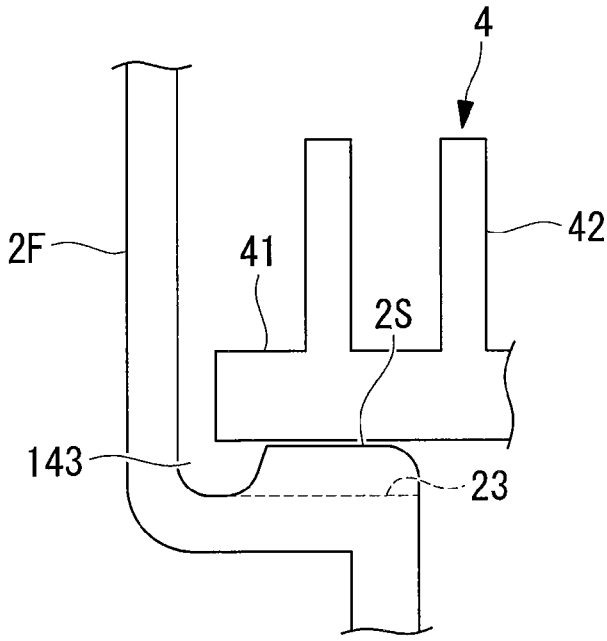
FIG. 7 is a cross-sectional view for explaining the structure of a communication section shown in FIG. 6.

As shown in FIGS. 6 and 7, a communication section 143 of a scroll compressor 101 is formed on a thrust surface 2S of the front housing 2F that is brought into contact with the orbiting end plate 41. Specifically, the communication section 143 is formed on the thrust surface 2S as a groove section that is concave in a direction in which the drive shaft 52 extends (downward in FIG. 7), that extends along the side wall of the front housing 2F in an arc manner, and that communicates with the supply flow paths 23.

Next, circulation of lubricant contained in refrigerant, which is a feature of this embodiment, will be described.

In a state where the scroll compressor 101 is operated, in other words, where the orbiting scroll 4 is driven in an orbital manner, most of the supply flow paths 23 are closed by the orbiting end plate 41 one time in one orbit of the orbiting scroll 4, as shown in FIG. 6.

At this time, the supply flow paths 23 and the suction chamber 21 are connected via the communication section 143 extending farther than the orbiting end plate 41, along the side wall of the front housing 2F. Therefore, refrigerant containing lubricant flows from the suction chamber 21 into the supply flow paths 23 via the communication section 143.

Note that, since a flow of refrigerant containing lubricant when the supply flow paths 23 are not closed by the orbiting end plate 41 is the same as that in the first embodiment, a description thereof will be omitted.

According to the above-described structure, for example, compared with the communication sections that are concave in the radial directions, a surface of the orbiting end plate 41 that is brought into contact with the fixed wall 32 is easily ensured. Furthermore, sufficient thickness of the side wall of the front housing 2F is easily ensured.

Figure 8:
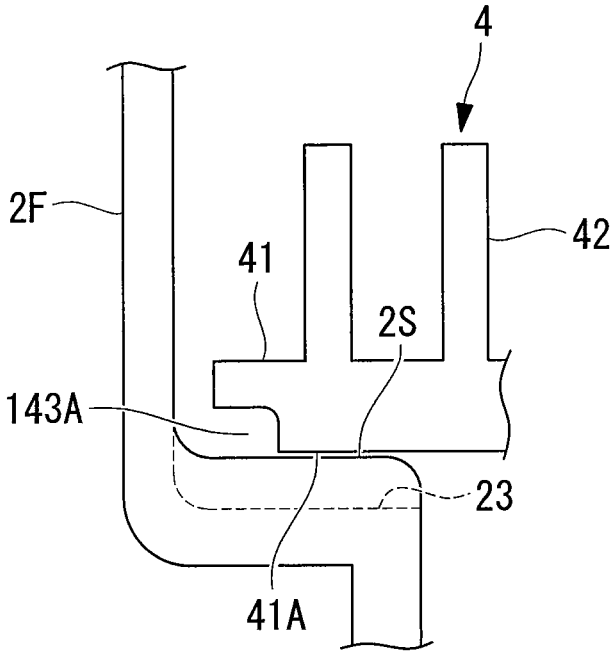
FIG. 8 is a cross-sectional view for explaining another embodiment of the communication section shown in FIG. 7.

FIG. 8 is a cross-sectional view for explaining another embodiment of the communication section shown in FIG. 7.

Note that the communication section 143 may be formed on the thrust surface 2S of the front housing 2F, as in the above-described embodiment, or a communication section 143A may be formed on a surface 41A of the orbiting end plate 41 facing the thrust surface 2S, as shown in FIG. 8; the position thereof is not particularly limited.

The communication section 143A is a step on the facing surface 41A, which is concave in a direction away from the thrust surface 2S outward in the radial direction, and is formed along the edge of the orbiting end plate 41 in an arc manner.

REFERENCE SIGNS LIST

1 scroll compressor
2F front housing (housing)
2R rear housing (housing)
3 fixed scroll
4 orbiting scroll
21 suction chamber
22 suction section
23 supply flow path
24 first bearing (bearing section)

31 fixed end plate
32 fixed wall
41 orbiting end plate
42 orbiting wall
43, 43A, 143, 143A communication section
52 drive shaft

The invention claimed is:

1. A scroll compressor comprising:

a housing;

a fixed scroll that has a fixed end plate on which a spiral fixed wall is provided upright and that is fixed in the housing;

an orbiting scroll that has an orbiting end plate on which a spiral orbiting wall is provided upright and that is supported in the housing so as to orbit while being prevented from rotating, in a state where the orbiting wall is engaged with the fixed wall;

a drive shaft that is rotatably supported by a bearing section provided in the housing and that transfers a rotational force to the orbiting scroll;

a suction section that makes refrigerant containing lubricant flow into a suction chamber provided in the housing;

a plurality of supply grooves that are provided on a thrust sliding surface of the housing which is in sliding contact with the orbiting end plate in an axial direction of the drive shaft, the supply grooves extending in a radial direction of the drive shaft, a radially outer end of each of the supply grooves being connected to the suction chamber and a radially inner end of each of the supply grooves being connected to a drive shaft housing chamber which houses a part of the drive shaft, and a communication section provided on at least one of an outer circumferential surface of the orbiting end plate and the thrust sliding surface of the housing so that the communication section is always connected to the suction chamber and the radially outer end of at least one of the supply grooves.

2. A scroll compressor according to claim 1, wherein the communication section is a concave formed by making a part of the outer circumferential surface of the orbiting end plate recessed in said radial direction.

3. A scroll compressor according to claim 2, wherein a depth of the concave provided on the outer circumferential surface of the orbiting end plate is smaller than a thickness of the fixed wall.

4. A scroll compressor according to claim 2, wherein:

the housing includes a front housing having a substantially cylindrical shape having a bottom, which is almost closed at an orbiting scroll side and is open at a fixed-scroll side, and a rear housing that covers an opening of the front housing; and a face of the concave provided on the outer circumferential surface of the orbiting end plate is tilted inward in the radial direction from an orbiting end plate side toward a fixed-end-plate side, the face facing the housing.

5. A scroll compressor according to claim 1, wherein the communication section is a groove extending in a circumferential direction about the drive shaft at a radially outer area of the thrust sliding surface of the housing so as to be connected to the radially outer end of at least one of the supply grooves.

* * * * *